United States Patent [19]

Walters

[11] 3,972,450

[45] Aug. 3, 1976

[54] CONTAINERS

[76] Inventor: Tom Walters, 2102 Mason Blvd., Point Pleasant, W. Va. 25550

[22] Filed: Mar. 10, 1975

[21] Appl. No.: 556,938

[52] U.S. Cl. ..... 222/91; 220/5 R; 220/72; 220/91; 220/DIG. 1; 220/DIG. 6; 220/143

[51] Int. Cl.[2] ..... B67B 7/26; B67D 5/60; B65D 7/02; B65D 25/32

[58] Field of Search ..... 220/5 R, 72, DIG. 1, 220/DIG. 6, 91; 222/91, 143

[56] References Cited

UNITED STATES PATENTS

| | | | |
|---|---|---|---|
| 2,624,486 | 1/1953 | Lee | 220/72 X |
| 2,661,872 | 12/1953 | Tractuetter | 222/143 |
| 2,814,418 | 11/1957 | Rieke | 220/266 X |
| 2,893,588 | 7/1959 | Martin | 220/72 |
| 3,294,271 | 12/1966 | Armbruster | 220/5 R |
| 3,357,593 | 12/1967 | Sears et al. | 220/72 |

*Primary Examiner*—Allen N. Knowles
*Assistant Examiner*—Hadd Lane

[57] ABSTRACT

Molded and or cast cylindrical container of suitable plastic or the like of the standard 55 gallon (U.S.) tight head universal drum outward dimensional appearance that has lifting recesses and yokes provided for handling by trolley, fork lift vehicle or the like, nozzles arranged for total container liquid content drainage either in the horizontal and or vertical position, blanked nozzle connections with aperture cutout removal innovation for use when and as desired, openings at the top chime for outside top head drainage and also to effect a falling film cooling system when water cooling the container's contents and or water drenching in the case of fire and other hazardous conditions, vacuum suction grip breaking grooves in bottom chime to prevent inherent suction effect when drum is placed on wet concrete floors or the like, an arrangement for safe stacking the containers, and a horizontal/vertical reinforcing lattice rib pattern to maintain the container's shape when under pressure and or resisting the forces of rough handling.

14 Claims, 10 Drawing Figures

CONTAINERS

This invention relates in general to a 55 gallon container that retains the outward block dimensions of the standard 55 gallon (U.S.) tight head universal drum, for reasons explained later, that permits conventional as well as an improved means of handling, that effects total drainage of its liquid contents, that has thorough internal cleaning feasibility, that has provisions to improve water spray cooling the container's contents as well as top head drainage, that has provisions to effect more support contact and balancing points for safely stacking said containers in line and or pyramid fashion, and that has affixed blanks in auxillary nozzles of the cutout removal type for usage of the connection when desired.

Drum handling has become a sophisticated system of automated devices, conveyors for drum filling and capping as well as computerized warehousing equipment for selective storing and shipping. All present drum handling equipment is designed for handling the standard 55 gallon tight head universal drum, excluding special systems. The outward block dimensional tolerances of this type drum should be adhered to for the like services and equipment to avoid impractical changing and or replacing present handling equipment.

The present standard 55 gallon tight head universal drum, due to its fabrication techniques, does not provide total drainage of its contents, nor can it be cleaned properly due to the chime crimp. The top head of a standing drum can fill with water etc., especially under spray systems, creating an undesirable condition. This type of drum provides no means to improve the removal of its contents, handling or stacking. Metal drums, when full, damage easily at high speed automated handling. Mainly they kink as they get banged around causing flat places that will not always spring back to shape. Damaged drums clog and stop much of the automated handling equipment, generally in a messy and hazardous pile of mashed and busted drums along with a flood of their contents.

It is therefore, an important object of the present invention to provide industry a container that maintains the outward dimensional tolerances of the standard 55 gallon tight head universal drum adaptable to present handling equipment and introduce innovations that improve container handling, provide a choice of total drainage removal of the container's contents in the horizontal and/or vertical positions, provide inwardly blanked molded in place nozzle ports of the cutout removal type for auxillary nozzles to be used when and as desired, provide the feasibility of thoroughly cleaning and draining the container's internal surfaces, provide a means for effective water bath cooling of the container and subsequently the container's contents as well as an aid to preventing fire hazardous conditions, provide a self draining top head, provide a means for safely stacking the containers one on top of the other and/or in pyramid fashion, and to provide a design for castable or moldable materials to withstand the rigors of automated container handling.

In accordance with the present invention, a cylindrical container is provided with a convex shaped top head for the purposes of resisting internal and external pressures and/or forces as well as to effect top head outer drainage of water or the like through openings at its perphery and/or when coolant water is applied. The bottom head is concave shaped for the purposes of resisting internal and external pressures and/or forces as well as to effect total drainage of the container's contents through the bottom chime (blanked) auxillary connection when said container is in the vertical position. A top head connection is provided for use with present filling systems. A top chime (blanked) auxillary connection is provided for total drainage of the container's contents when said container is in the horizontal position. Built in lifting recesses and yokes are provided to aid in maintaining the container in a vertical position when being lifted by fork lift vehicles, overhead trolleys, hoists and the like. Grooves are provided at the contact rim of the bottom chime to act as vacuum suction breakers when said container is stored on smooth wet flooring. Outward roll and or contact rings centrally and horizontally located upon the cylindrical shell are provided for conventional handling. Horizontal and vertical rib lattices are provided affixed to the outside of the cylindrical shell for the purposes of resisting internal and external pressures or forces as well as to transmit the shock of forces due to rough usage, inherent with automated drum handling, to greater areas of absorption to aid said container to retain its cylindrical shape. Outward bosses are affixed on the top and bottom heads to provide more contact and balancing points for safe stacking.

These together with other objects and advantages which will become subsequently apparent reside in the details on construction and usage as more fully hereinafter described and claimed, references being had to the accompanying drawings forming a part hereof, wherein like numerals refer to like parts throughout.

Figure 2:
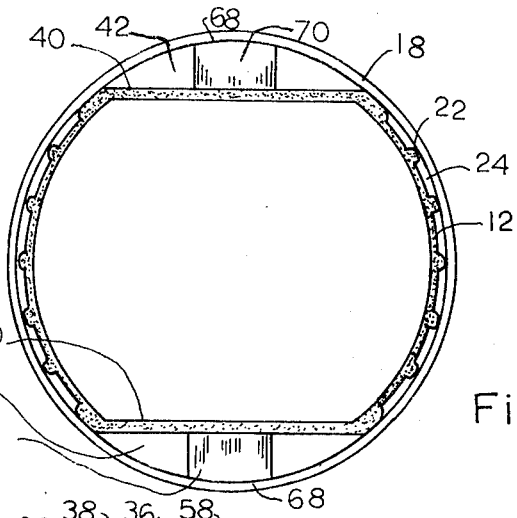
FIG. 2 is a sectional plan view taken substantially at a plane indicated by section lines 2—2 in FIG. 1 showing the lifting recesses and lifting yokes.
Figure 1:
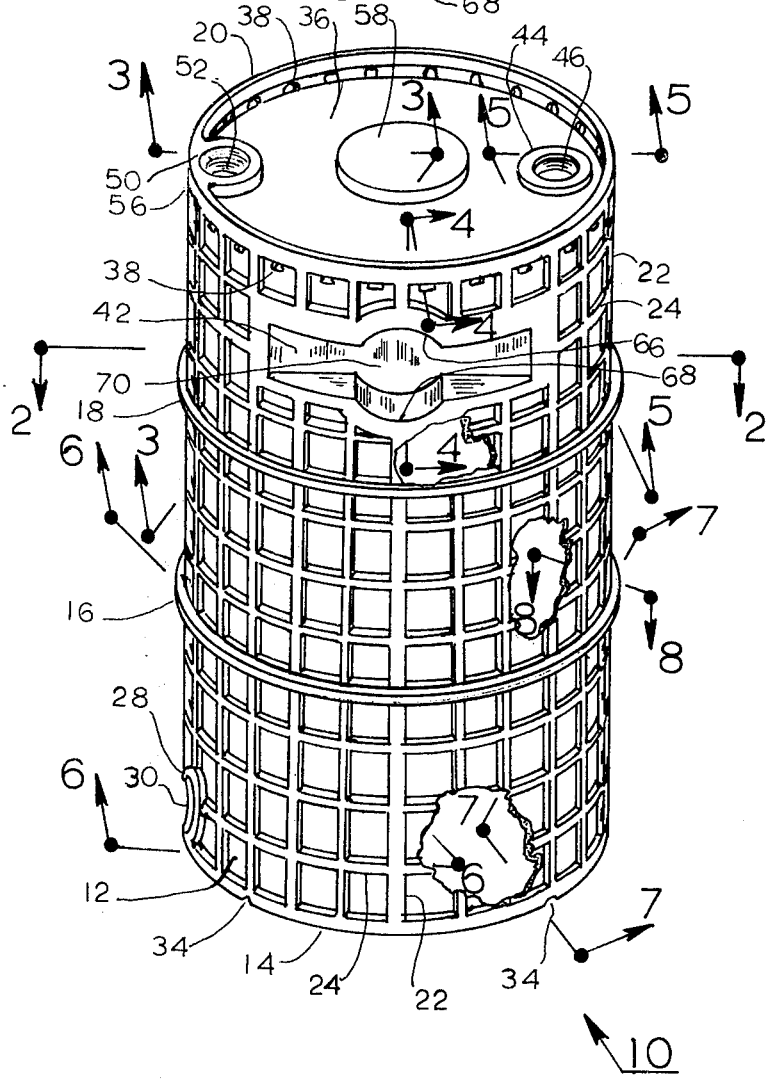
FIG. 1 is a perspective view showing a container's outward appearance adapted to the present invention.

Referring now to the drawings in detail, FIG. 1 shows a typical plastic or the like container 10 of cast or molded construction in accordance with the present invention. In FIGS. 1, 2, 3, 4, 5, 6 and 8 cylindrical side shell 12 with outward horizontal ribs 24, outward horizontal roll and or contact rings 16 and 18, outward vertical ribs 22 is affixed to lower concave head 26, lower chime 14, recessed lower chime nozzle boss 28 encompassing nozzle connection 30, and is affixed to upper convex head 36, upper chime 20, upper chime nozzle face boss 50 and side boss 56 that encompass nozzle connection 52, and side shell 12 is also affixed and part of lifting recess bolsters 40, yoke bolsters 66 and 68 that house lifting recesses 42 and 70 respectively. Convex head 36 has nozzle boss 44 affixed that encompasses the standard nozzle connection 46 with threads 48.

Figure 4:
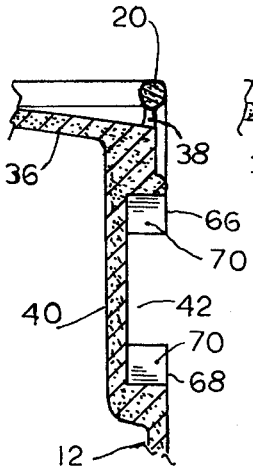
FIG. 4 is a partial sectional view taken substantially at a plane indicated by section line 4—4—4 in FIG. 1 showing an upper corner of the container's ribbed side shell, convex head with typical top head drain port at the chime and one of the two opposed lifting recesses and yokes.
Figure 5:
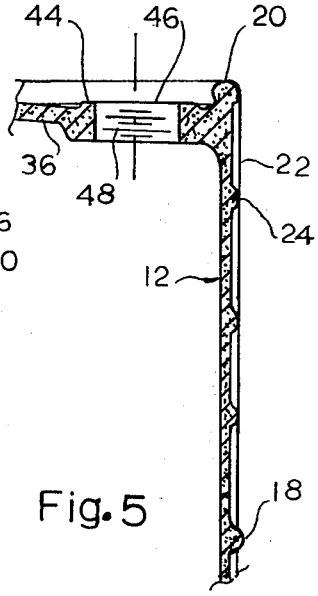
FIG. 5 is a partial sectional view taken substantially at a plane indicated by section lines 5—5—5 in FIG. 1 showing an upper corner of the container's ribbed side shell, convex head, chime and the standard filling connection.
Figure 8:
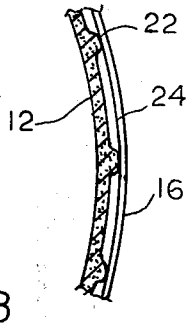
FIG. 8 is a partial sectional plan view taken substantially at a plane indicated by section line 8—8 in FIG. 1 showing the container's ribbed side shell and a typical roll and or contact ring.

Drain ports 38 shown in FIG. 1 and FIG. 4 in side shell 12 are spaced between vertical ribs 22 and centered over horizontal ribs 24 to effect an even distribution of coolant liquid down over the container when said container is in the normal storage vertical position.

Figure 7:
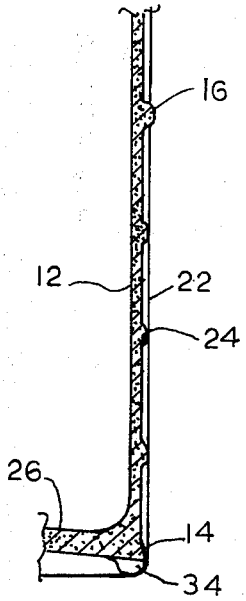
FIG. 7 is a partial sectional view taken substantially at a plane indicated by section line 7—7—7 in FIG. 1 showing the container's ribbed side shell, concave head, chime and typical vacuum suction breaking grooves.

Grooves 34 shown in FIG. 1 and FIG. 7 on chime 14 are intended for liquid and or air passage channels to prevent suction effect, when moving stored containers, due to temperature changes and/or wet smooth floor conditions.

Figure 3:
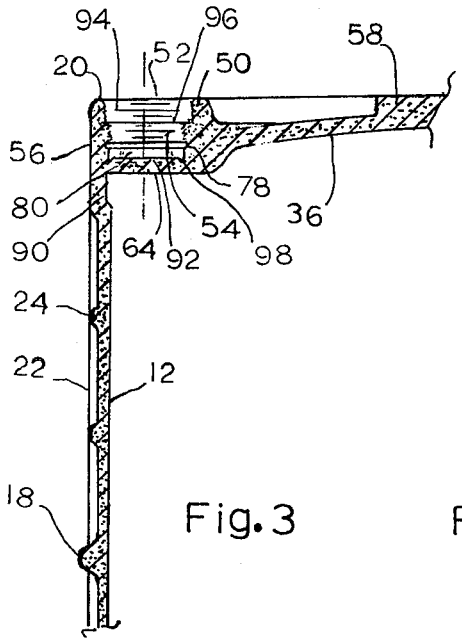
FIG. 3 is a partial sectional view taken substantially at a plane indicated by section 3—3—3 in FIG. 1 showing an upper corner of the container's ribbed side shell, convex head, chime, blanked auxillary chime nozzle connection and stacking boss.

In FIG. 3 nozzle connection 52 with threads 94, 80 with recess 98 and blank 64 shown encompassed within head boss 50, side boss 56 with clearance channel 90 which are encompassed within head 36, chime 20 and shell 12 in a manner, with blank 64 removed by cutting-/tapping device 304 or the like that permits total drainage of the container's contents when said container 10 is advantageously laid in the horizontal position as indicated in FIGS. 25 and 27.

In FIG. 1 and FIG. 3 boss 58 is shown affixed centrally to convex head 36 for the purpose of stacking the containers.

Figure 6:
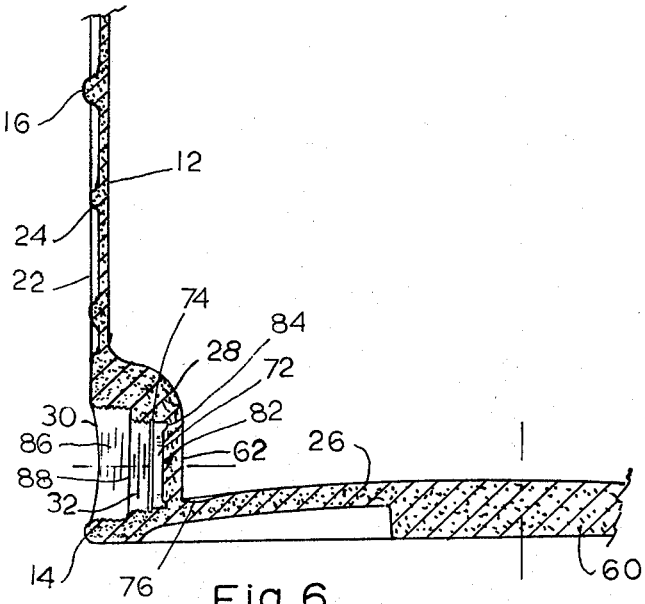
FIG. 6 is a partial sectional view taken substantially at a plane indicated by section lines 6—6—6 in FIG. 1 showing a lower corner of the container's ribbed side shell, concave head, chime, lower chime blanked auxillary side nozzle connection and stacking boss.
Figure 9:
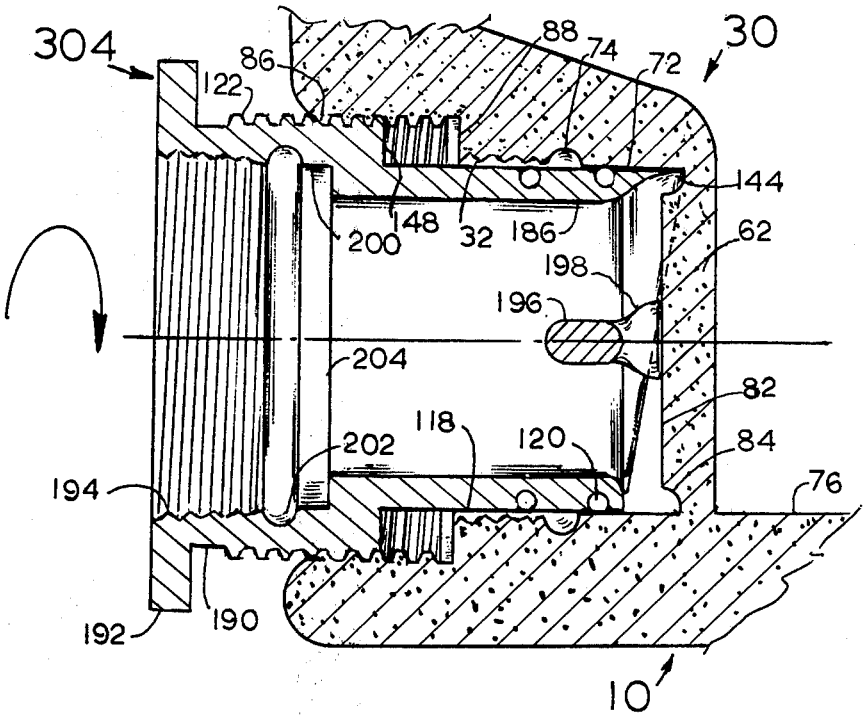
FIGS. 9 and 10 are partial sectional views showing the beginning and end of the making of a dispensing connection by a cutter in a blank aperture of the container.
Figure 10:
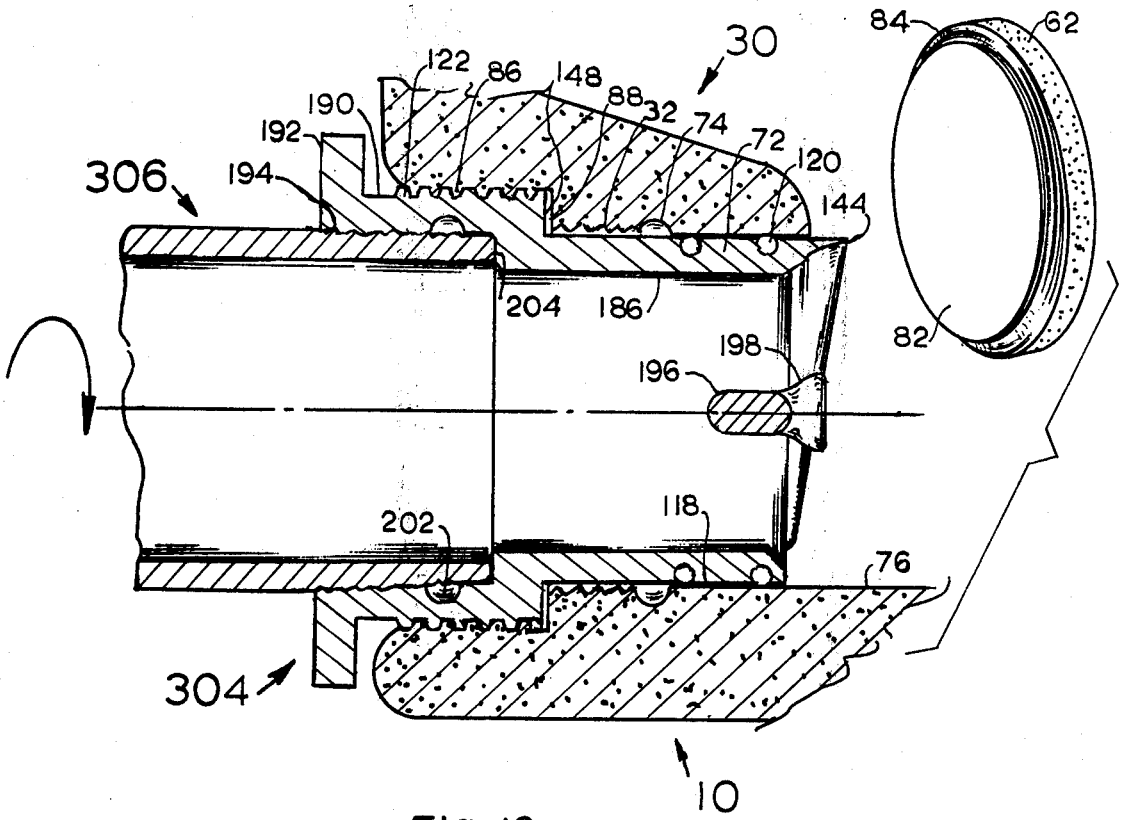

In FIG. 6 nozzle connection 30 with threads 86, shoulder 88, threads 32, recess 74, cylindrical trunk 72 with recess 84 and blank 62 is shown encompassed within boss 28 which is encompassed within head 26, chime 14 and shell 12 in a manner, with blank 62 removed by cutter/tapping device 304 or the like that permits total drainage of the containers when said container 10 is placed in the normal vertical position as shown in FIGS. 9 and 10.

FIGS. 9 and 10 are shown for illustrative purposes for making use of blanked connections for dispensing the container's contents.

FIG. 9 with connection 30 being typical of the blanked type connections is shown with acme type, or the like, threads 86 entering the connection aperture ending at shoulder 88, pipe threads 32 continuing on to thread relief recess 74, cylindrical trunk continuing on to recess 84 which is contained in the connection blank 62. Cutter 304 with barrel 190 having threads 122 received by threads 86 of connection 30, cylindrical barrel 118 with "O" ring seal 120 received by trunk 72 of 30 and cutter tip 144 of 304 entered into recess 84 of 62 of connection 30. Cutter 304 has hexagonal flange 192 as a means for wrench rotation, and pipe threads 194 as a means for attaching piping, valve or the like for container contents removal.

In FIG. 10 cutter 304 is shown further rotated upon threads 122 to where shoulder 148 contacts shoulder 88 of connection 30 to limit entering travel of O ring 120 to within the effective seal area when cutter tip 144 of barrel 118 cuts blank 62 free to float away. Inner cylindrical wall 186 of barrel 118 has cross support 196 with prod 198 centrally affixed to aid in thrusting the cut blank 62 away from the opening at the cutting operation. Cutter 304 has thread relief recess 202, cylindrical chamber 200 and shoulder 204 along with threads 194 to receive attachments such as pipe 306 or the like.

While the preceding descriptions refer to the present invention as having the outward appearances of a standard drum for handling liquids, the descriptions were not intended to limit the appearance nor limit the usage of liquids. It is conceivable that the present invention will be also used for shipping granular, perelited, pelleted and the like materials, and become a continual reusable shipping and storing container because of its versatility and the feasibility of thoroughly cleaning all internal surfaces.

The foregoing is considered as illustrative only of the principles of the invention. Further, since numerous modifications and changes will readily occur to those skilled in the art, it is not desired to limit the invention to the exact construction and usage shown and described, and accordingly all suitable modifications and equivalents my be resorted to, falling within the scope of the invention.

What is claimed as new is as follows:

1. A tight head container molded from semi-rigid impact resistant high molecular weight high density polyethylene comprising the combination of a substantially cylindrical side shell section having molded continuous therewith an outward lattice pattern of horizontal and vertical solid reinforcing/water spray control ribs of substantially radial intersecting contours with said side shell, centrally located contact/roll rings, opposed container lifting recesses having lifting yoke pin positioning sockets, auxiliary internally and integrally sealed closed cycle dispensing connection above the bottom chime, and a convex head closure at the top end having a standard container fill connection, an auxiliary internally and integrally sealed closed cycle dispensing connection, a combination outward reinforcing/stacking and utility boss, a liquids dispensing orificed standing chime functional in conjunction with said outward lattice ribs and contact/roll rings, and a concave head closure at the bottom end having a combination outward reinforcing/stacking and utility boss, a standing grooved bottom chime, wherein the above container component configurations provide a continuity of molded strength throughout the container in a manner that provides the internal surface of the container with smooth intersecting substantially radial contours and free of potentially contaminating causing grooves, ledges and container content catch pockets upon dispensing container contents through said auxiliary closed cycle connections.

2. The combination of claim 1 wherein said top standing chime's liquid dispensing orifices include configurations to evenly dispense said liquid between the vertical lattice ribs for use at container water spray systems.

3. The combination of claim 1 wherein said bottom standing chime has grooves that include configurations providing liquid and air passage channels for the elimination of potential suction grip adherence of the container to smooth wet flooring.

4. The combination of claim 1 wherein said outward lattice pattern of horizontal and vertical water spray control ribs include the configurations to channel and direct a controlled even spread of liquid down over the container in a falling film protecting/cooling application of said liquid.

5. The combination of claim 1 wherein said top head closure's auxiliary internally and integrally sealed dispensing connection is encompassed within the container in such a manner to provide total drainage of the container's liquid contents when said container is advantageously maintained in the horizontal position at tapping said connection.

6. The combination of claim 1 wherein said side shell's auxiliary internally and integrally sealed dispensing connection is encompassed within the container in such a manner to provide total drainage of the container's liquid contents when said container is advantageously maintained in the vertical position at tapping said connection.

7. The combination of claim 1 wherein said opposed lifting recesses having lifting yoke pin positioning sockets wherein said sockets include configurations that upon receiving lifting yoke pins of container lifting apparatus said sockets maintain said pins positioned for lifting the container in a balanced manner by said sockets swivelling about said pins to maintain the container in the vertical position at container handling.

8. The combination of claim 1 wherein said top and bottom head closures have a combination outward reinforcing/stacking and utility boss wherein said boss design includes configurations to provide additional support areas at container stacking permitting a choice of aligned, staggered and pyramid container stacking in a safe manner.

9. The combination of claim 1 wherein said top and bottom head closures have a combination outward reinforcing/stacking and utility boss wherein said boss design includes the configurations and purpose of being available for adapting the container with large filling/-dispensing connections for handling granular, pelleted and the like materials.

10. The combination of claim 1 wherein said auxiliary internally and integrally sealed dispensing connection has design configurations that include part of the container components as the internal seal area.

11. The combination of claim 1 wherein said auxiliary internally and integrally sealed dispensing connection includes a seal receiving chamber for the use with cutter/tapping adaptors for the removal of the container's liquid contents in a closed cycle manner without the escapement of vapors and liquids at said connection during the cutting/tapping procedure.

12. The combination of claim 1 wherein said auxiliary internally and integrally sealed dispensing connection includes full engagement threads for a conventional piping connection usage.

13. The combination of claim 1 wherein said auxiliary internally and integrally sealed dispensing connection includes an annular groove to receive and secure thrust type expandable plug seals.

14. The combination of claim 1 wherein the said container components include the configurations to substantially maintain the outward shape dimensional tolerances of the standard 55 gallon (U.S.) tight head universal drum and be readily adaptable to present drum automated handling equipment.

* * * * *